US008087477B2

(12) United States Patent
Sullivan et al.

(10) Patent No.: US 8,087,477 B2
(45) Date of Patent: Jan. 3, 2012

(54) METHODS AND APPARATUSES FOR MEASURING DRILL BIT CONDITIONS

(75) Inventors: Eric C. Sullivan, Houston, TX (US); Tu Tien Trinh, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 347 days.

(21) Appl. No.: 12/435,729

(22) Filed: May 5, 2009

(65) Prior Publication Data

US 2010/0282510 A1 Nov. 11, 2010

(51) Int. Cl.
*E21B 47/01* (2006.01)
*G06F 19/00* (2006.01)

(52) U.S. Cl. ..... 175/40; 703/1; 702/1

(58) Field of Classification Search ..... 75/40, 50; 702/1; 703/1
See application file for complete search history.

(56) References Cited

U.S. PATENT DOCUMENTS

| | | | | |
|---|---|---|---|---|
| 4,884,071 | A | 11/1989 | Howard | |
| 4,904,865 | A * | 2/1990 | Meisner et al. | 250/254 |
| 5,351,532 | A * | 10/1994 | Hager | 73/152.55 |
| 5,517,024 | A * | 5/1996 | Mullins et al. | 250/254 |
| 5,675,674 | A * | 10/1997 | Weis | 385/12 |
| 5,758,539 | A * | 6/1998 | Naville et al. | 73/152.03 |
| 6,389,187 | B1 | 5/2002 | Greenaway et al. | |
| 6,422,084 | B1 | 7/2002 | Fernald et al. | |
| 6,668,465 | B2 * | 12/2003 | Noureldin et al. | 33/304 |
| 6,814,162 | B2 | 11/2004 | Moran et al. | |
| 6,837,314 | B2 * | 1/2005 | Krueger et al. | 175/59 |
| 6,904,200 | B2 | 6/2005 | Wang et al. | |
| 7,219,729 | B2 | 5/2007 | Bostick, III et al. | |
| 7,255,173 | B2 | 8/2007 | Hosie et al. | |
| 2006/0132792 | A1 | 6/2006 | Schultz et al. | |
| 2006/0140529 | A1 | 6/2006 | Childers | |
| 2007/0151390 | A1 | 7/2007 | Blumenkranz et al. | |
| 2007/0156019 | A1 | 7/2007 | Larkin et al. | |
| 2007/0272442 | A1 * | 11/2007 | Pastusek et al. | 175/40 |
| 2008/0066960 | A1 | 3/2008 | Mathiszik et al. | |

OTHER PUBLICATIONS

International Search Report for International Application No. PCT/US2010/033510 mailed Jan. 4, 2011, 4 pages.
International Written Opinion for International Application No. PCT/US2010/033510 mailed Jan. 4, 2011, 5 pages.
Baldwin et al., "Review of Fiber Optic Accelerometers," Systems Planning & Analysis, Inc., Imac XXIII Conference & Exposition on Structural Dynamics, Jan. 31-Feb. 3, 2005, 7 pages.
Doornink et al., "Remote Health Monitoring of a High Performance Steel Bridge using Fiber Optic Technology," Bridge Engineering Center, Iowa State University Research Park, 2004, 5 pages.
Fonda et al., "Embedded Fiber Optic Sensing for Bridge Rehabilitation," University of Missouri-Rolla, 2004, 9 pages.
Kersey et al., "Fiber Grating Sensors," Journal of Lightwave Technology, vol. 15, No. 8, Aug. 1997, pp. 1442-1463. Wikipedia, "Fiber Bragg grating," http://en.wikipedia.org/wiki/Bragg_grating, accessed Jul. 17, 2007, 9 pages.
Wikipedia, "Well drilling," http://en.wikipedia.org/wiki/Well_drilling, accessed Jul. 17, 2007, 3 pages.

* cited by examiner

*Primary Examiner* — Kenneth L Thompson
(74) *Attorney, Agent, or Firm* — TraskBritt

(57) ABSTRACT

Drill bits and methods of measuring drill bit conditions are disclosed. A drill bit for drilling a subterranean formation comprises a bit bearing at least one cutting element and adapted for coupling to a drill string. The drill bit may also comprise a chamber formed within the bit and configured for maintaining a pressure substantially near a surface atmospheric pressure while drilling the subterranean formation. In addition, the drill bit may comprise at least one optical sensor disposed in the chamber and configured for sensing at least one physical parameter exhibited by the drill bit while drilling a subterranean formation.

23 Claims, 11 Drawing Sheets

METHODS AND APPARATUSES FOR MEASURING DRILL BIT CONDITIONS

TECHNICAL FIELD

The present invention relates generally to drill bits for drilling subterranean formations and, more particularly, to methods and apparatuses for monitoring downhole conditions during drilling operations.

BACKGROUND

The oil and gas industry expends sizable sums to design cutting tools, such as downhole drill bits including roller cone rock bits and fixed cutter bits, which have relatively long service lives, with relatively infrequent failure. In particular, considerable sums are expended in the design and manufacture of roller cone rock bits and fixed cutter bits in a manner that minimizes the opportunity for catastrophic drill bit failure during drilling operations. The loss of a roller cone or a polycrystalline diamond compact (PDC) from a fixed cutter bit during drilling operations can impede the drilling operations and, at worst, necessitate rather expensive fishing operations. If the fishing operations fail, so-called "sidetrack drilling" operations must be performed in order to drill around the portion of the wellbore containing the lost roller cones or PDC cutters. Typically, during drilling operations, bits are pulled and replaced prematurely with new bits even though significant service could still be obtained from the replaced bit. Such premature replacements of downhole drill bits are expensive, since each trip out of the well prolongs the overall drilling activity, and consumes considerable manpower, but are nevertheless done in order to avoid the far more disruptive and expensive process of, at best, pulling the drill string and replacing the bit upon detection of failure or, at worst, having to undertake fishing and sidetrack drilling operations necessary if one or more cones or compacts are lost due to bit failure.

With the ever-increasing need for downhole drilling system dynamic data, a number of "subs" (i.e., a sub-assembly including sensors incorporated into the drill string above the drill bit and used to collect data relating to drilling parameters) have been designed and installed in drill strings. Unfortunately, these subs cannot provide actual data for what is happening operationally at the bit due to their remote physical placement above the bit itself.

Data acquisition is conventionally accomplished by mounting a sub in the bottom-hole assembly (BHA) several feet to tens of feet away from the bit. Data gathered from a sub this far away from the bit may not accurately reflect what is happening directly at the bit while drilling occurs. Often, this lack of data leads to conjecture as to what may have caused a bit to fail or why a bit performed so well, with no directly relevant facts or data to correlate to the performance of the bit.

There is a need for a drill bit equipped to measure and report data that is related to performance and condition of the drill bit during operation. Such a drill bit may extend useful bit life in a given wellbore, enable re-use of a bit in multiple drilling operations and provide an ability to develop drill bit performance data on existing drill bits, which may be used for developing future improvements to drill bits.

BRIEF SUMMARY OF THE INVENTION

In one embodiment of the present invention, a drill bit for drilling a subterranean formation comprises a drill bit bearing at least one cutting element and adapted for coupling to a drill string. Furthermore, the drill bit comprises at least one optical sensor disposed in the drill bit and configured for sensing at least one physical parameter in the drill bit.

Another embodiment of the invention comprises an apparatus for drilling a subterranean formation including a drill bit bearing at least one cutting element and adapted for coupling to a drill string and a chamber formed within the bit and configured for maintaining a pressure substantially near a surface atmospheric pressure while drilling the subterranean formation. Furthermore, the apparatus comprises at least one optical sensor disposed in the drill bit and configured for sensing at least one physical parameter and an electronics module disposed in the drill bit. The electronics module comprises a memory, a processor, and a sensor interface having a light source. The sensor interface is coupled to the at least one optical sensor and the processor is operably coupled to the memory and the sensor interface. Additionally, the processor is configured for executing computer instructions. The computer instructions are configured for controlling delivery of a light signal from the light source to the at least one optical sensor and analyzing a reflected light signal from the at least one optical sensor.

Another embodiment of the invention includes a method comprising providing at least one optical sensor within a drill bit and measuring at least one physical parameter associated with the drill bit from the at least one optical sensor.

DETAILED DESCRIPTION OF THE INVENTION

Embodiments of the present invention include a drill bit and optical sensors disposed within the drill bit configured for measuring downhole conditions during drilling operations.

Figure 1:
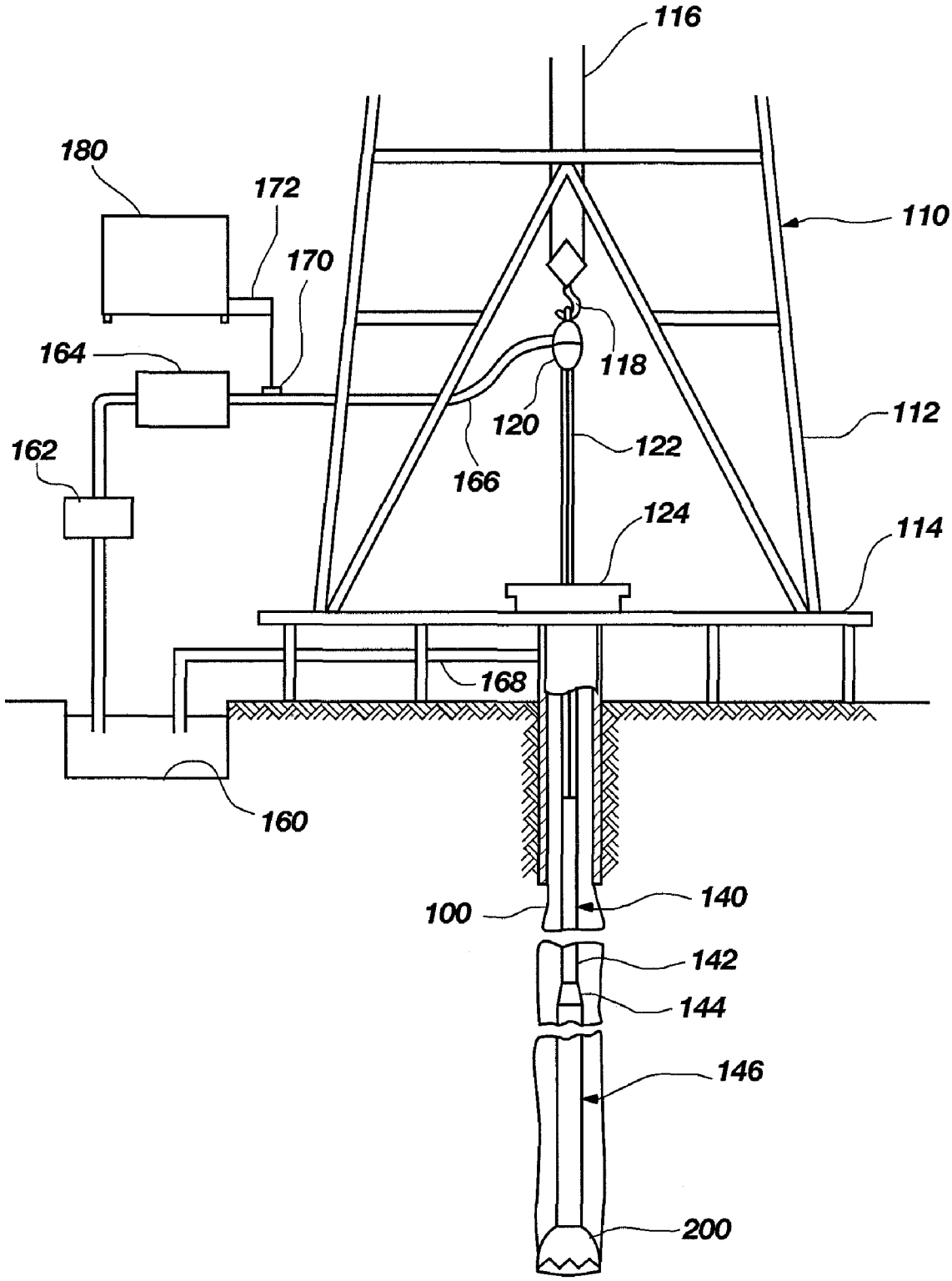
FIG. 1 illustrates a conventional drilling rig for performing drilling operations.

FIG. 1 depicts an example of conventional apparatus for performing subterranean drilling operations. Drilling rig 110 includes a derrick 112, a derrick floor 114, a draw works 116, a hook 118, a swivel 120, a Kelly joint 122, and a rotary table 124. A drill string 140, which includes a drill pipe section 142 and a drill collar section 144, extends downward from the drilling rig 110 into a borehole 100. The drill pipe section 142 may include a number of tubular drill pipe members or strands connected together and the drill collar section 144 may likewise include a plurality of drill collars. In addition, the drill string 140 may include a measurement-while-drilling (MWD) logging subassembly and cooperating mud pulse telemetry data transmission subassembly, which are collectively referred to as an MWD communication system 146, as well as other communication systems known to those of ordinary skill in the art.

During drilling operations, drilling fluid is circulated from a mud pit 160 through a mud pump 162, through a desurger 164, and through a mud supply line 166 into the swivel 120. The drilling mud (also referred to as drilling fluid) flows through the Kelly joint 122 and into an axial central bore in the drill string 140. Eventually, the drilling mud exits through apertures or nozzles, which are located in a drill bit 200, which is connected to the lowermost portion of the drill string 140 below drill collar section 144. The drilling mud flows back up through an annular space between the outer surface of the drill string 140 and the inner surface of the borehole 100, to be circulated to the surface where it is returned to the mud pit 160 through a mud return line 168.

A shaker screen (not shown) may be used to separate formation cuttings from the drilling mud before it returns to the mud pit 160. The MWD communication system 146 may utilize a mud pulse telemetry technique to communicate data from a downhole location to the surface while drilling operations take place. To receive data at the surface, a mud pulse transducer 170 is provided in communication with the mud supply line 166. This mud pulse transducer 170 generates electrical signals in response to pressure variations of the drilling mud in the mud supply line 166. These electrical signals are transmitted by a surface conductor 172 to a surface electronic processing system 180, which is conventionally a data processing system with a central processing unit for executing program instructions, and for responding to user commands entered through either a keyboard or a graphical pointing device. The mud pulse telemetry system is provided for communicating data to the surface concerning numerous downhole conditions sensed by well logging and measurement systems that are conventionally located within the MWD communication system 146. Mud pulses that define the data propagated to the surface are produced by equipment conventionally located within the MWD communication system 146. Such equipment typically comprises a pressure pulse generator operating under control of electronics contained in an instrument housing to allow drilling mud to vent through an orifice extending through the drill collar wall. Each time the pressure pulse generator causes such venting, a negative pressure pulse is transmitted to be received by the mud pulse transducer 170. An alternative conventional arrangement generates and transmits positive pressure pulses. As is conventional, the circulating drilling mud also may provide a source of energy for a turbine-driven generator subassembly (not shown) which may be located near a bottom-hole assembly (BHA). The turbine-driven generator may generate electrical power for the pressure pulse generator and for various circuits including those circuits that form the operational components of the measurement-while-drilling tools. As an alternative or supplemental source of electrical power, batteries may be provided, particularly as a backup for the turbine-driven generator.

Figure 2:
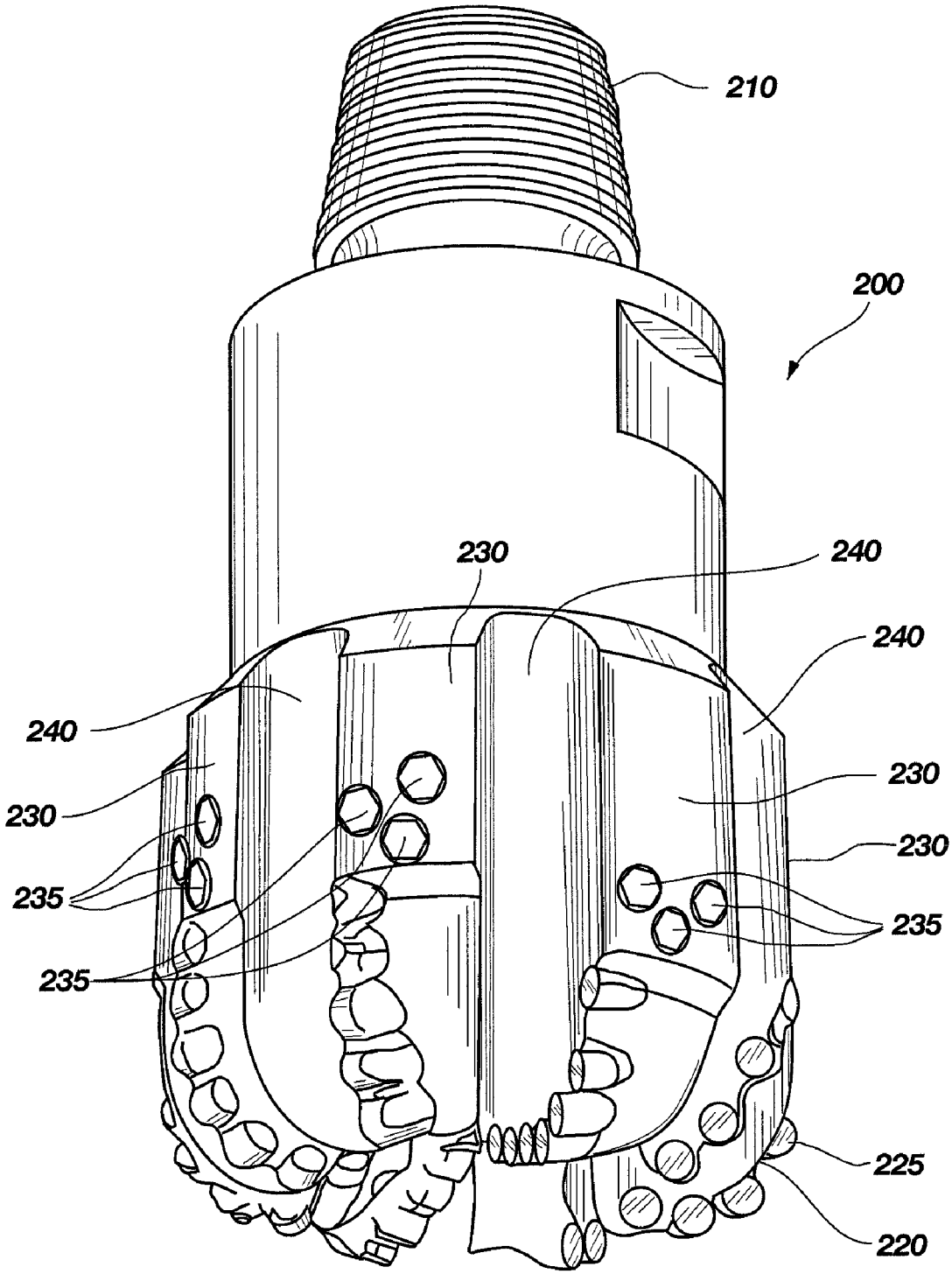
FIG. 2 is a perspective view of a conventional matrix-type rotary drag bit.

FIG. 2 is a perspective view of an example of a drill bit 200 of a fixed-cutter, or so-called "drag" bit, variety. Conventionally, the drill bit 200 includes threads at a shank 210 at the upper extent of the drill bit 200 for connection into the drill string 140 (see FIG. 1). At least one blade 220 (a plurality shown) at a generally opposite end from the shank 210 may be provided with a plurality of natural or synthetic diamonds (polycrystalline diamond compact) cutters 225, arranged along the rotationally leading faces of the blades 220 to effect efficient disintegration of formation material as the drill bit 200 is rotated in the borehole 100 under applied weight-on-bit (WOB). A gage pad surface 230 extends upwardly from each of the blades 220, is proximal to, and generally contacts the sidewall of the borehole 100 (FIG. 1) during drilling operation of the drill bit 200. A plurality of channels 240, termed "junk slots," extend between the blades 220 and the gage pad surfaces 230 to provide a clearance area for removal of formation chips formed by the cutters 225.

A plurality of gage inserts 235 is provided on the gage pad surfaces 230 of the drill bit 200. Shear cutting gage inserts 235 on the gage pad surfaces 230 of the drill bit 200 provide the ability to actively shear formation material at the sidewall of the borehole 100 and to provide improved gage-holding ability in earth-boring bits of the fixed cutter variety. The drill bit 200 is illustrated as a PDC ("polycrystalline diamond compact") bit, but the gage inserts 235 may be equally useful in other fixed cutter or drag bits that include gage pad surfaces 230 for engagement with the sidewall of the borehole 100.

Those of ordinary skill in the art will recognize that the present invention may be embodied in a variety of drill bit types. The present invention possesses utility in the context of a tricone or roller cone rotary drill bit or other subterranean drilling tools as known in the art that may employ nozzles for delivering drilling mud to a cutting structure during use. Accordingly, as used herein, the term "drill bit" includes and encompasses any and all rotary bits, including core bits, roller cone bits, fixed cutter bits; including PDC, natural diamond, thermally stable produced (TSP) synthetic diamond, and diamond impregnated bits without limitation, eccentric bits, bicenter bits, reamers, reamer wings, as well as other earth-boring tools configured for acceptance of an electronics module, sensors, or any combination thereof, as described more fully below.

Figure 3A:
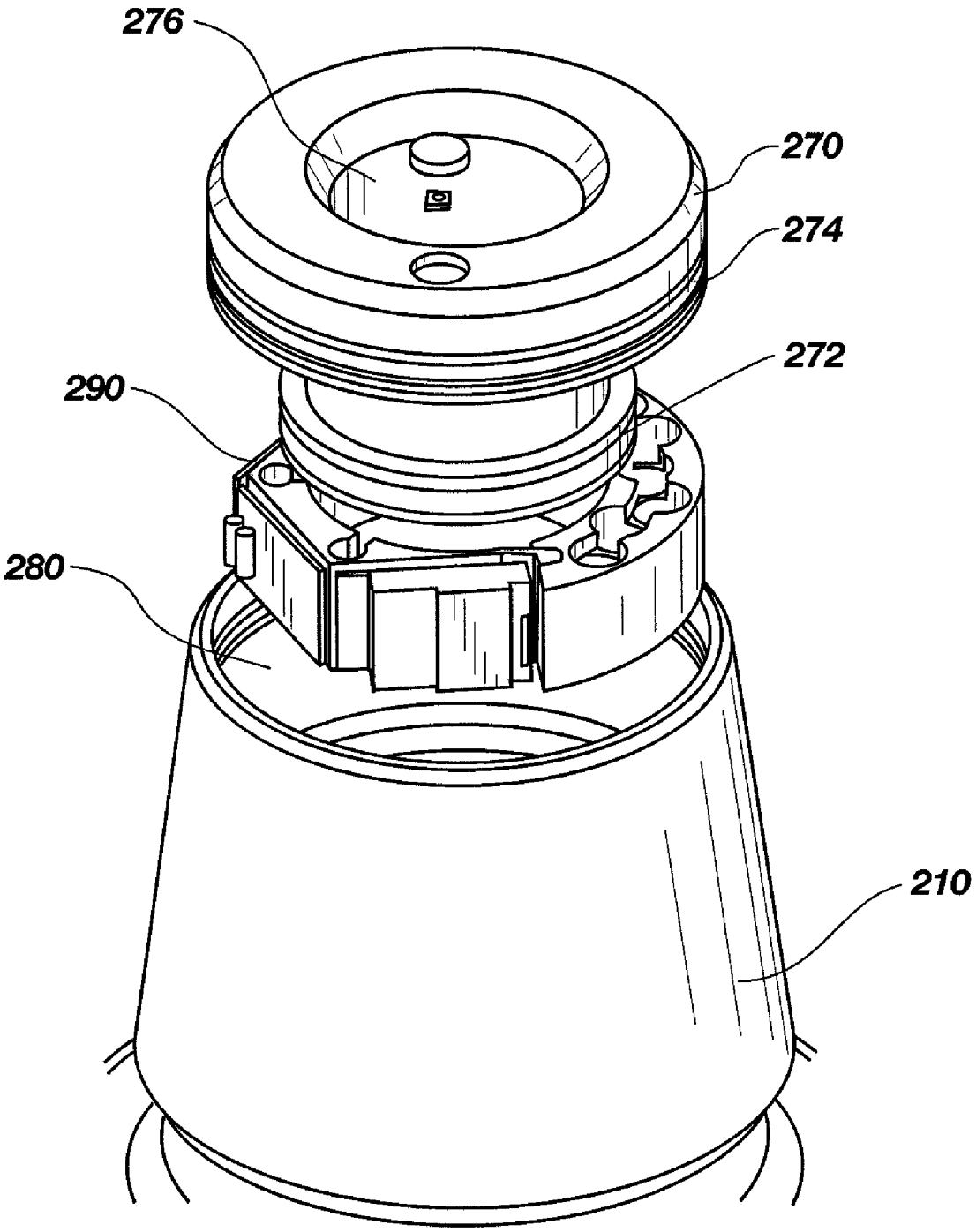
FIG. 3A is a perspective view of a shank and an end cap.
Figure 3B:
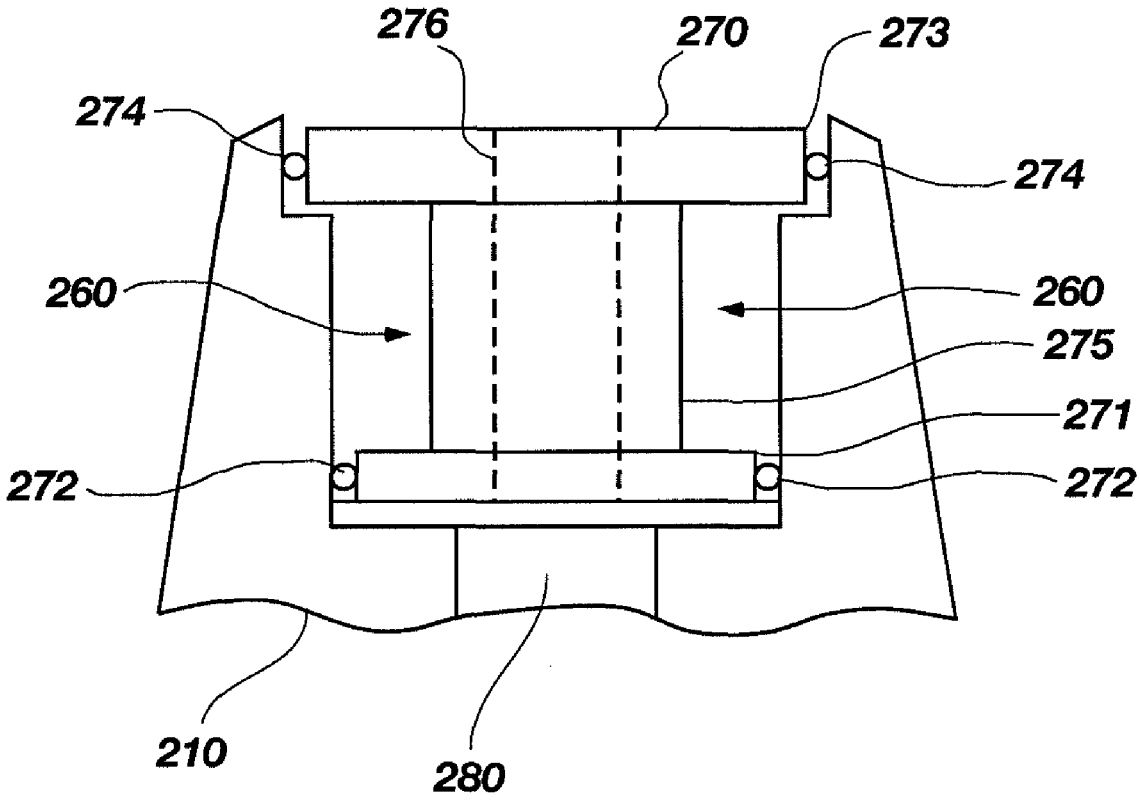
FIG. 3B is a cross-sectional view of a shank and an end cap.

FIGS. 3A and 3B illustrate an embodiment of a shank 210 secured to a drill bit 200 (not shown), and an end cap 270. The shank 210 includes a central bore 280 formed through the longitudinal axis of the shank 210. In conventional drill bits 200, this central bore 280 is configured for allowing drilling mud to flow therethrough. In the present invention, at least a portion of the central bore 280 is given a diameter sufficient for accepting an electronics module 290 configured in a substantially annular ring, yet without substantially affecting the structural integrity of the shank 210. Thus, the electronics module 290 may be placed down in the central bore 280, about the end cap 270, which extends through the inside diameter of the annular ring of the electronics module 290 to create a fluid tight annular chamber 260 (FIG. 3B) with the wall of central bore 280 and seal the electronics module 290 in place within the shank 210.

The end cap 270 includes a cap bore 276 formed therethrough, such that the drilling mud may flow through the end cap 270, through the central bore 280 of the shank 210 to the other side of the shank 210, and then into the body of drill bit 200. In addition, the end cap 270 includes a first flange 271 (see FIG. 3B) including a first sealing ring 272, near the lower end of the end cap 270, and a second flange 273 including a second sealing ring 274, near the upper end of the end cap 270.

FIG. 3B is a cross-sectional view of the end cap 270 disposed in the shank 210, illustrating the annular chamber 260 formed between the first flange 271, the second flange 273, the end cap body 275, and the walls of the central bore 280.

The first sealing ring 272 and the second sealing ring 274 form a protective, fluid tight, seal between the end cap 270 and the wall of the central bore 280. The protective seal formed by the first sealing ring 272 and the second sealing ring 274 may provide the ability to maintain the annular chamber 260 at approximately atmospheric pressure during drilling operations.

In the embodiment shown in FIGS. 3A and 3B, the first sealing ring 272 and the second sealing ring 274 are formed of material suitable for a high-pressure, high-temperature environment, such as, for example, a Hydrogenated Nitrile Butadiene Rubber (HNBR) O-ring in combination with a PEEK back-up ring. In addition, the end cap 270 may be secured to the shank 210 with a number of connection mechanisms such as, for example, a secure press-fit using sealing rings 272 and 274, a threaded connection, an epoxy connection, a shape-memory retainer, welding, and brazing. It will be recognized by those of ordinary skill in the art that the end cap 270 may be held in place quite firmly by a relatively simple connection mechanism due to differential pressure and downward mud-flow during drilling operations.

In addition to placing electronics module 290 within drill bit 200, one or more optical sensors 340 (see FIGS. 4-7) may be placed within the drill bit 200, or above the drill bit 200 in the bottom-hole assembly. Furthermore, optical sensors 340 may be placed within drill bit 200 at a location proximate to a blade 220 or a cutter 225 (see FIG. 2). Additionally, optical sensors 340 may be placed within a groove or chamber formed within drill bit 200, as described more fully below.

Optical sensors 340 may include one or more optical fibers, each optical fiber employing multiple fiber Bragg gratings. Furthermore, as known in the art, each grating within an optical fiber may be configured as a sensor for measuring a physical parameter. As known by one of ordinary skill in the art, a fiber Bragg grating refers to periodically spaced changes in the refractive index made in the core of an optical fiber. These periodic changes reflect a very narrow range of specific wavelengths of light passing through the fiber while transmitting other wavelengths. As known in the art, a reflected signal may be compared with a transmitted signal to determine differences between the two signals. The signal differences may be correlated to various physical parameters in order to determine a physical parameter within drill bit 200. Furthermore, depending on the doping of a particular grating, the grating may be configured as a sensor to measure physical parameters such as, for example, strain, temperature, or pressure at the location of the grating. Additionally, an applied load or torque at a location within drill bit 200 or at a cutter 225 may be calculated from a strain measurement.

Figure 4A:
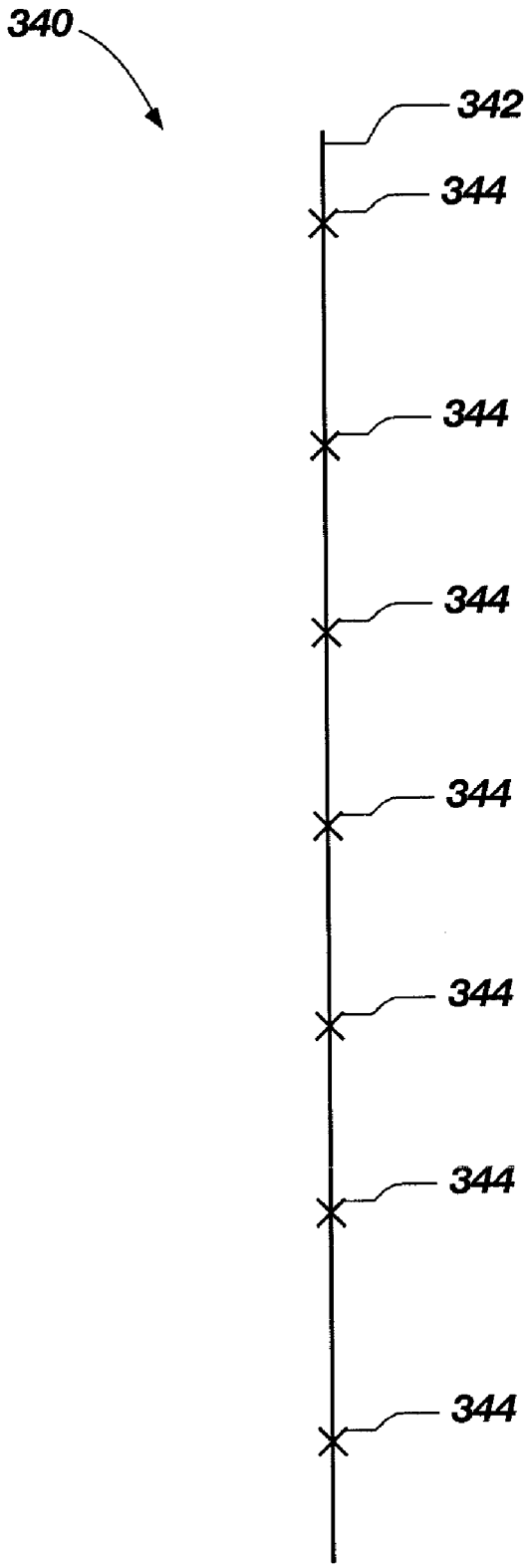
FIG. 4A illustrates an optical fiber including fiber Bragg gratings formed therein, according to an embodiment of the present invention.

As shown in FIG. 4A, an optical sensor 340 may include an optical fiber 342 having one or more fiber Bragg gratings 344 formed therein, wherein each grating 344 may be configured to sense an indication of a physical parameter (i.e., temperature, strain, or pressure) exhibited by a drill bit. For example only, and not by way of limitation, each fiber Bragg grating 344 may be configured to sense an indication of strain exhibited at a corresponding grating location within the optical fiber 342. In another embodiment, an optical sensor 340 may include an optical fiber 342 having one or more fiber Bragg gratings 344, wherein each grating 344 may be configured to sense an indication of one of a plurality of physical parameters exhibited by a drill bit. Stated another way, a single optical fiber 342 may include one or more fiber Bragg gratings 344, wherein each grating 344 may be configured to sense temperature, pressure, or strain exhibited at the corresponding grating location within the optical fiber 342.

Figure 4B:
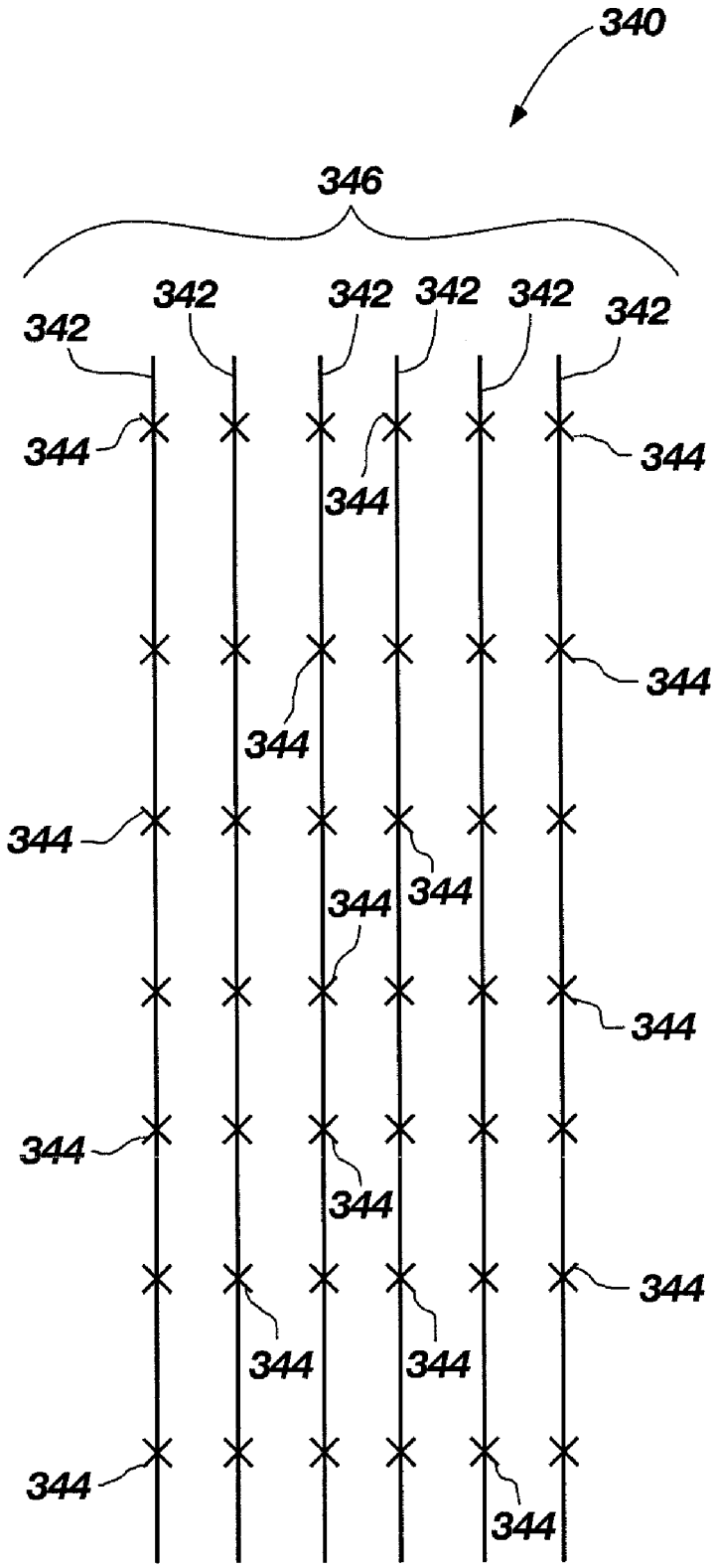
FIG. 4B illustrates a network of optical fibers including fiber Bragg gratings formed therein, in accordance with an embodiment of the present invention.
Figure 5:
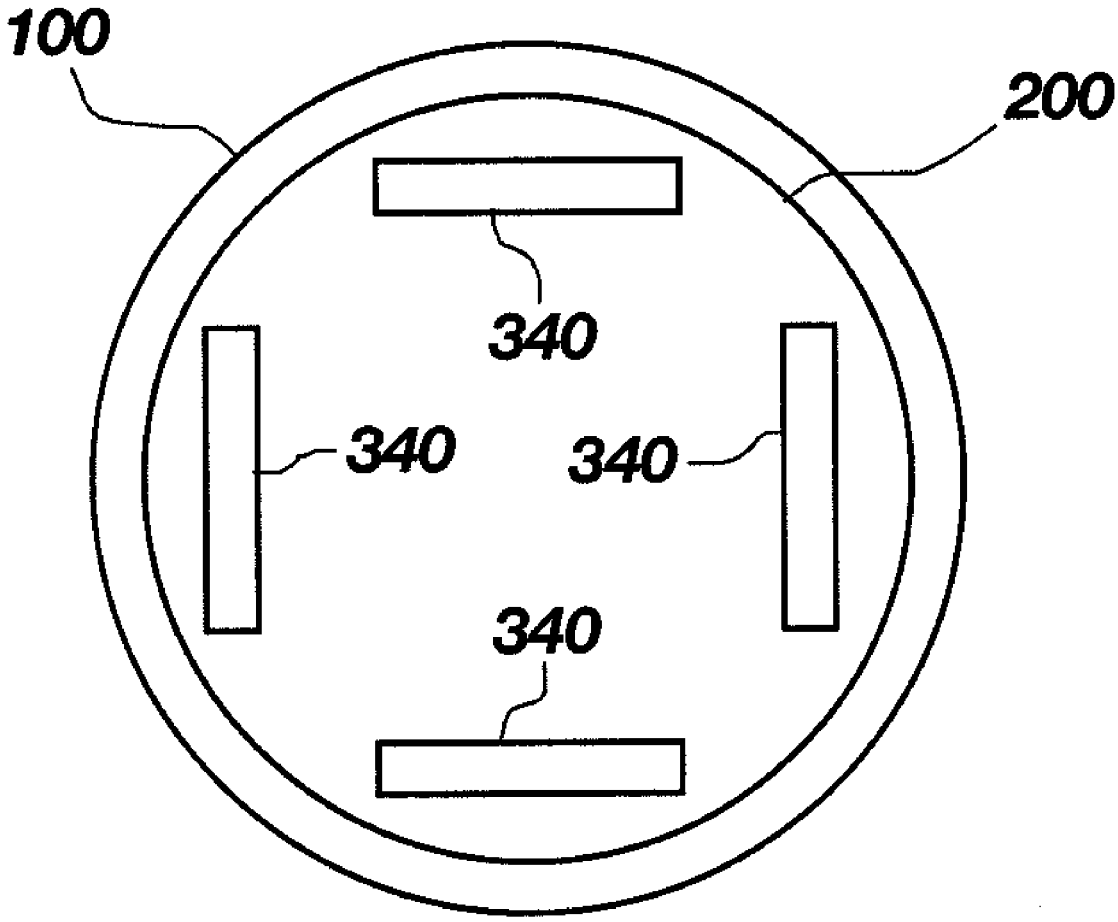
FIG. 5 illustrates placement of optical sensors within a drill bit in accordance with an embodiment of the present invention.

Furthermore, as shown in FIG. 4B, optical sensor 340 may be configured as a network 346 of optical fibers 342, wherein each optical fiber 342 within the network 346 may include one or more fiber Bragg gratings 344 configured to sense an indication of physical parameter (i.e., temperature, pressure, or strain) exhibited by a drill bit. For example only, and not by way of limitation, each optical fiber 342 within the network 346 of optical fibers may include one or more fiber Bragg gratings 344 configured to sense an indication of a temperature exhibited at a corresponding location of each grating 344 within the network. Furthermore, in another embodiment, optical sensor 340 may be configured as a network 346 of optical fibers 342, wherein each optical fiber 342 within the network 346 may include one or more fiber Bragg gratings 344 configured to sense an indication of one of a plurality of physical parameters exhibited by a drill bit. For example only, and not by way of limitation, each optical fiber 342 within the network 346 of optical fibers 342 may include one or more fiber Bragg gratings 344 configured to sense an indication of strain exhibited at locations of one or more gratings 344, sense an indication of temperature exhibited at locations of one or more gratings 344, and/or sense an indication of pressure exhibited at locations of one or more gratings 344 within the optical fiber 342. As a result, optical sensors 340 may include a network 346 of optical fibers 342 having one or more fiber Bragg gratings 344 configured to sense an indication of strain exhibited at locations within the drill bit, a network 346 of optical fibers 342 having one or more fiber Bragg gratings 344 configured to sense an indication of pressure exhibited at locations within the drill bit, and/or a network 346 of optical fibers 342 having one or more fiber Bragg gratings 344 configured to sense an indication of temperature exhibited at locations within the drill bit. Furthermore, optical sensors 340 may include a single network 346 of optical fibers 342 having one or more fiber Bragg gratings 344 configured to sense an indication of strain exhibited at corresponding grating locations within the drill bit, temperature exhibited at corresponding locations within the drill bit, and/or pressure exhibited at corresponding grating locations within the drill bit. FIG. 5 is a top view of a drill bit 200 within a borehole 100 illustrating non-limiting examples of optical sensor 340 placements in various locations within drill bit 200.

The optical fibers 342 including gratings 344, as shown in FIG. 4A, and network 346 of optical fibers 342 including gratings 344, as illustrated in FIG. 4B, are only non-limiting examples of contemplated optical sensor 340 configurations. As such, various modifications and alternative forms of an optical fiber 342 including gratings 344 and a network 346 of optical fibers 342 including gratings 344 are within the scope of the invention.

As mentioned above, drill bit 200 may be configured to receive electronics module 290, sensors 340, or any combination thereof. In an embodiment wherein drill bit 200 comprises a steel body drill bit, a groove or chamber may be milled out of drill bit 200 and an optical fiber including fiber Bragg gratings may be affixed within the groove or chamber. Subsequently, the groove or chamber may be capped and sealed to protect the optical sensor 340. In an embodiment wherein drill bit 200 comprises a cast bit, it may be required to place the optical sensor within a cast bit subsequent to casting the bit due to the fact that some fiber optic gratings may not be able to withstand temperatures employed in casting. As a result, in order to create a groove or chamber within a cast bit, a sand or clay piece, termed a "displacement" may be placed into a bit mold prior to casting. After casting the mold, the sand or clay piece may be broken and removed to create a groove or chamber within the body of the cast bit.

Thereafter, an optical fiber including fiber Bragg gratings may be affixed within the groove or chamber and the groove or chamber may be subsequently capped and sealed to protect the optical sensor 340. Other fiber optic gratings, such as sapphire gratings, may withstand casting temperatures and, therefore, may be placed into a bit mold prior to casting.

Figure 6A:
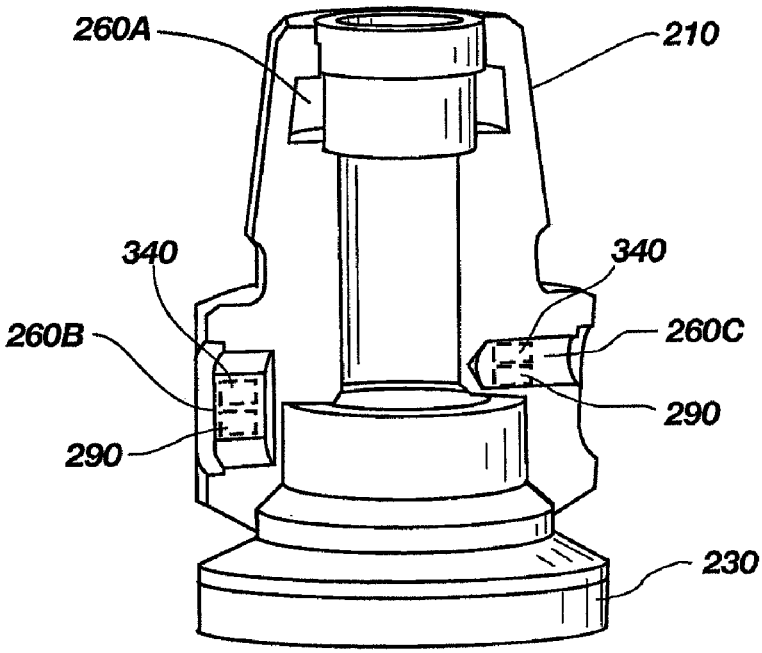
FIGS. 6A-6E are perspective views of a drill bit illustrating locations in a drill bit according to an embodiment of the present invention wherein an electronics module, optical sensors, or combinations thereof may be located.

FIGS. 6A-6E are perspective views of a drill bit 200 illustrating locations in the drill bit 200 wherein electronics module 290, optical sensors 340, or combinations thereof may be located. FIG. 6A illustrates an oval cut out 260B, located behind the oval depression (which may also be referred to as a torque slot) used for stamping the bit with a serial number may be milled out to accept the electronics. This area could then be capped and sealed to protect electronics module 290 and/or optical sensors 340. Alternatively, a round cut out 260C located in the oval depression used for stamping the bit may be milled out to accept electronics module 290 and/or optical sensors 340, then may be capped and sealed to protect the electronics module 290 and/or optical sensors 340. In addition, the shank 210 includes an annular race 260A formed in the central bore 280. The annular race 260A may allow expansion of the electronics module 290 and/or optical sensors 340 into the annular race 260A as the end-cap 270 (see FIGS. 3A and 3B) is disposed into position.

Figure 6B:
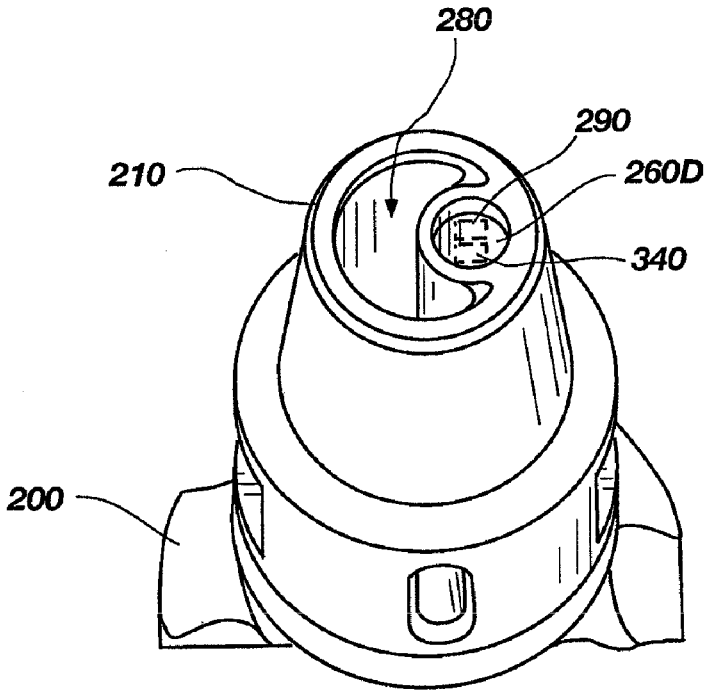

FIG. 6B illustrates an alternate configuration of the shank 210. A circular depression 260D may be formed in the shank 210 and the central bore 280 formed around the circular depression 260D, allowing transmission of the drilling mud. The circular depression 260D may be capped and sealed to protect the electronics module 290 and/or optical sensors 340 within the circular depression 260D.

Figure 6C:
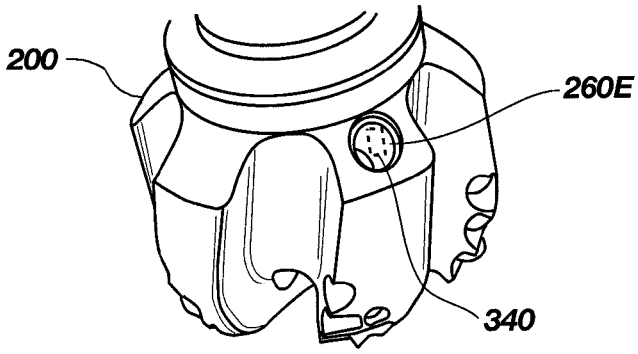
Figure 6D:
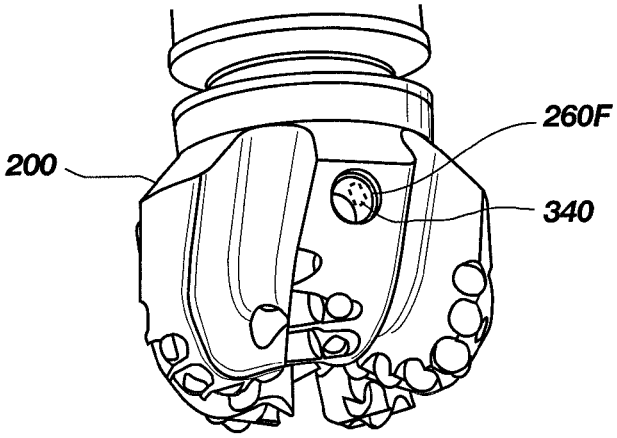
Figure 6E:
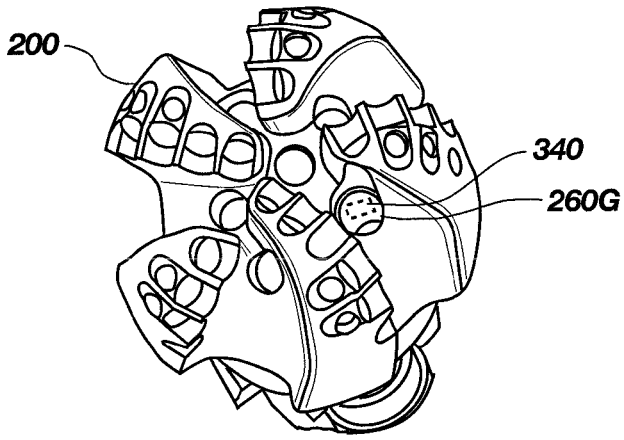

FIGS. 6C-6E illustrates circular depressions (260E, 260F, 260G) formed in locations on the drill bit 200. These locations offer a reasonable amount of room for electronics module 290 and/or optical sensors 340 while still maintaining acceptable structural strength in the blade.

Figure 7:
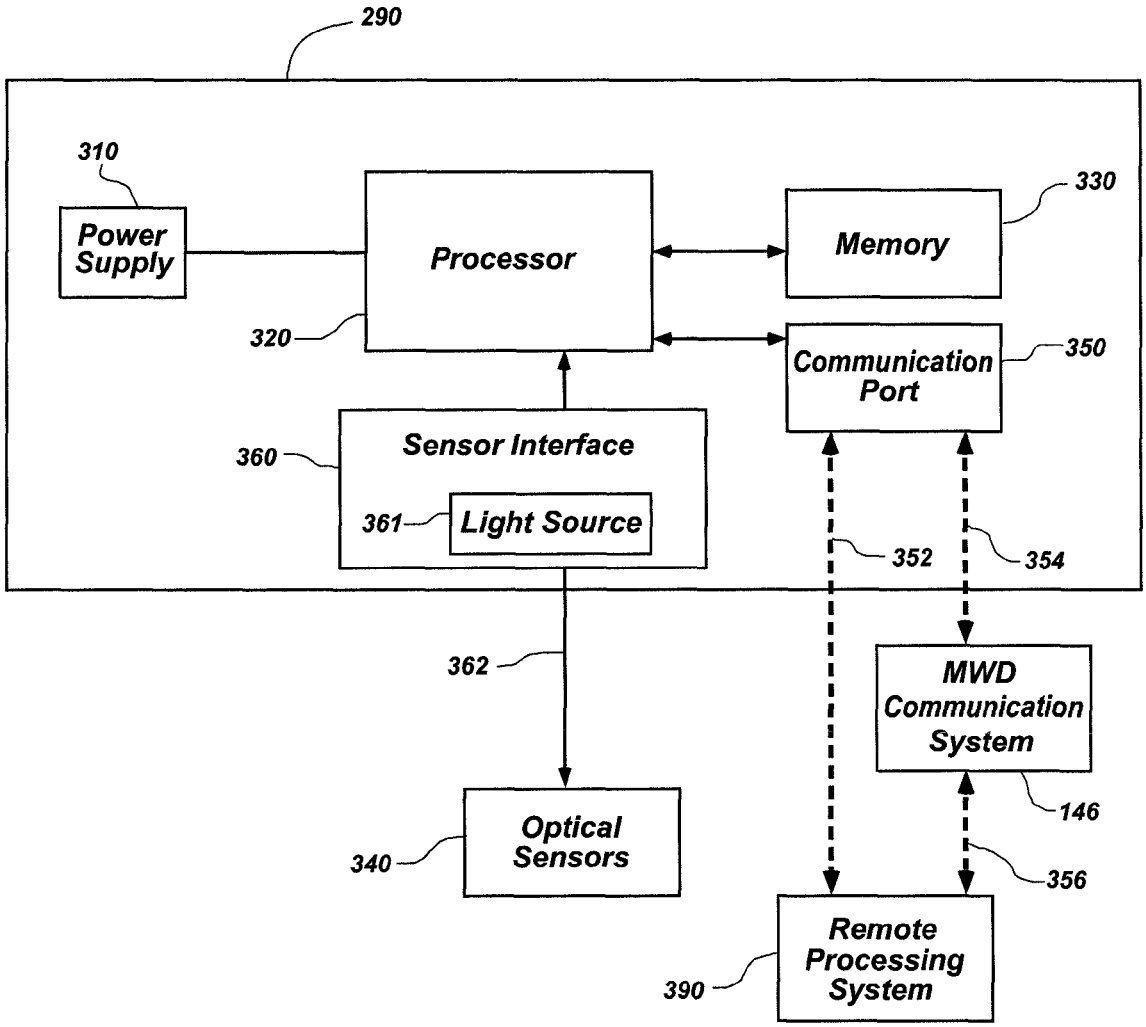
FIG. 7 is a block diagram of an electronics module according to an embodiment of the present invention.

FIG. 7 illustrates an embodiment of an electronics module 290, which may be configured to perform a variety of functions. Electronics module 290 may include a power supply 310, a processor 320, and a memory 330. Furthermore, electronics module 290 may include a sensor interface 360 coupled to each optical sensor 340 via an optical cable 362. Sensor interface 360 may include a light source 361, such as a laser, and appropriate equipment for delivery of a light to the Bragg gratings formed within the core of the optical fibers of optical sensors 340. Light source 361 may comprise a light source with a known and controllable frequency. It should be noted that each light source 361 may be operably coupled to one or more optical sensors 340. Furthermore, it should be noted that a wavelength of the light emitted from light source 361 may be varied depending on a parameter to be sensed. Furthermore, sensor interface 360 may further include logic circuitry, which encompasses any suitable circuitry and processing equipment necessary to perform operations including receiving and/or analyzing the return signals (reflected light) from the one or more optical sensors 340.

Figure 8A:
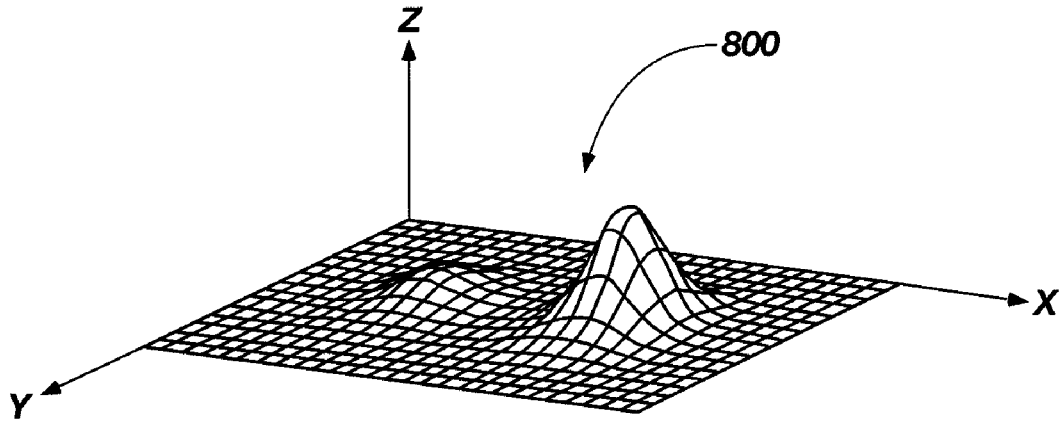
FIGS. 8A and 8B illustrate a gray-scale map and a black-and-white (shaded) rendering of a color-coded map, respectively.
Figure 8B:
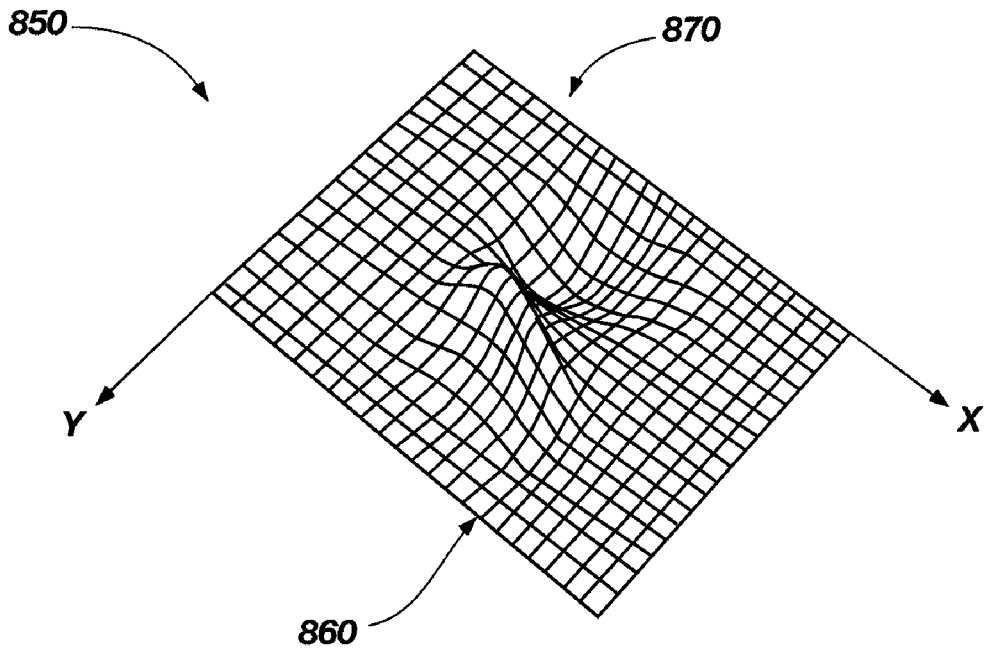

Electronics module 290 may also include processing equipment configured to generate a map illustrating a degree of temperature, pressure, or strain exhibited at locations within a drill bit. For example, in an embodiment wherein network 346 (see FIG. 4B) includes a plurality of fiber Bragg gratings 344 configured to sense an indication of a physical parameter (i.e., temperature, pressure, or strain), measurements obtained at each grating 344 may be processed by electronics module 290 to generate a 3D map, such as a gray-scale map or a color-coded map, illustrating the degrees of strain, temperature, or pressure exhibited at locations within a drill bit. FIG. 8A illustrates a gray scale map 800, wherein an x-axis and a y-axis of map 800 may indicate a location within the drill bit 200 at which the physical parameter was sensed and the z-axis of map 800 may indicate an amplitude of the sensed physical parameter. Furthermore, electronics module 290 may be configured to generate a color-coded map 850 (see FIG. 8B for a black-and-white rendering thereof), wherein an x-axis and a y-axis of the color-coded map 850 may indicate a location within the drill bit 200 at which the physical parameter was sensed and an amplitude of the sensed physical parameter may be represented by a color (e.g., blue, green, or yellow). For example, the portion of color-coded map 850 having a darker color (i.e., region 860) may represent a region where the amplitude of a sensed physical parameter is less than the amplitude of the sensed physical parameter at another region represented by portions of color-coded map 850 having a lighter color (i.e., region 870). As known in the art, a map may then be compared to a finite element analysis (FEA) model of a particular drill bit in order to predict possible bit failures with a reasonable certainty.

It may be advantageous to measure physical conditions of a drill bit within a downhole environment using optical sensors employing the previously described Bragg grating technology in that such technology is rugged, reliable, and relatively inexpensive to manufacture and operate. Furthermore, optical sensors have no downhole electronics or moving parts and, therefore, may be exposed to harsh downhole operating conditions without the typical loss of performance exhibited by electronic sensors.

Memory 330 may be used for storing sensor data, signal processing results, long-term data storage, and computer instructions for execution by the processor 320. Portions of the memory 330 may be located external to the processor 320 and portions may be located within the processor 320. The memory 330 may comprise Dynamic Random Access Memory (DRAM), Static Random Access Memory (SRAM), Read Only Memory (ROM), Nonvolatile Random Access Memory (NVRAM), such as Flash memory, Electrically Erasable Programmable ROM (EEPROM), or combinations thereof. In the FIG. 7 embodiment, the memory 330 is a combination of SRAM in the processor (not shown), Flash memory 330 in the processor 320, and external Flash memory 330. Flash memory may be desirable for low power operation and ability to retain information when no power is applied to the memory 330.

A communication port 350 may be included in the electronics module 290 for communication to external devices such as the MWD communication system 146 and a remote processing system 390. The communication port 350 may be configured for a direct communication link 352 to the remote processing system 390 using a direct wire connection or a wireless communication protocol, such as, by way of example only, infrared, BLUETOOTH®, and 802.11a/b/g protocols. Using the direct communication, the electronics module 290 may be configured to communicate with a remote processing system 390, such as, for example, a computer, a portable computer, and a personal digital assistant (PDA) when the drill bit 200 is not downhole. Thus, the direct communication link 352 may be used for a variety of functions, such as, for example, to download software and software upgrades, to enable setup of the electronics module 290 by downloading configuration data, and to upload sample data and analysis data. The communication port 350 may also be used to query the electronics module 290 for information related to the drill bit 200, such as, for example, bit serial number, electronics module serial number, software version, total elapsed time of bit operation, and other long term drill bit data which may be stored in the NVRAM.

The communication port 350 may also be configured for communication with the MWD communication system 146 in a bottom-hole assembly via a wired or wireless communication link 354 and protocol configured to enable remote communication across limited distances in a drilling environment as are known by those of ordinary skill in the art. One available technique for communicating data signals to an adjoining subassembly in the drill string 140 (FIG. 1) is depicted, described, and claimed in U.S. Pat. No. 4,884,071 entitled "Wellbore Tool With Hall Effect Coupling," which issued on Nov. 28, 1989 to Howard and the disclosure of which is incorporated herein by reference.

The MWD communication system 146 may, in turn, communicate data from the electronics module 290 to a remote processing system 390 using mud pulse telemetry 356 or other suitable communication means suitable for communication across the relatively large distances encountered in a drilling operation.

The processor 320 in the embodiment of FIG. 7 is configured for processing, analyzing, and storing collected sensor data. In addition, the processor 320 in the embodiment includes internal SRAM and NVRAM. However, those of ordinary skill in the art will recognize that the present invention may be practiced with memory 330 that is only external to the processor 320 as well as in a configuration using no external memory 330 and only memory 330 internal to the processor 320.

While the present invention has been described herein with respect to certain embodiments, those of ordinary skill in the art will recognize and appreciate that it is not so limited. Rather, many additions, deletions, and modifications to these embodiments may be made without departing from the scope of the invention as hereinafter claimed, including legal equivalents. In addition, features from one embodiment may be combined with features of another embodiment while still being encompassed within the scope of the invention.

What is claimed is:

1. A drill bit for drilling a subterranean formation, comprising:

a drill bit bearing at least one cutting element and adapted for coupling to a drill string;

at least one optical sensor disposed in the drill bit and configured for sensing an indication of at least one physical parameter exhibited by the drill bit while drilling the subterranean formation; and an electronics module disposed in the drill bit and configured for executing computer instructions, the computer instructions configured for analyzing a reflected light signal from the at least one optical sensor to develop a strain map correlated with the sensing the indication of the at least one physical parameter exhibited by the drill bit.

2. The drill bit of claim 1, wherein the at least one optical sensor is disposed proximate to the at least one cutting element.

3. The drill bit of claim 1, wherein the at least one optical sensor comprises at least one network of optical fibers configured for sensing an indication of the at least one physical parameter exhibited by the drill bit while drilling the subterranean formation.

4. The drill bit of claim 1, wherein the at least one optical sensor is disposed within a channel formed within the drill bit.

5. The drill bit of claim 4, wherein the at least one optical sensor is affixed in the channel and the channel is capped and sealed to protect the at least one optical sensor.

6. The drill bit of claim 1, wherein the at least one physical parameter is selected from the group consisting of a strain at a location in the drill bit, a temperature at a location in the drill bit, a pressure at a location in the drill bit, an applied load at a location in the drill bit, a torque at a location in the drill bit, and an applied load on the at least one cutting element.

7. The drill bit of claim 1, wherein the at least one optical sensor comprises a fiber Bragg grating formed within an optical fiber.

8. The drill bit of claim 1, wherein the bit comprises one of a tricone bit and a fixed cutter bit.

9. The drill bit of claim 8, wherein the fixed cutter bit comprises one of a cast bit and a steel body bit.

10. The drill bit of claim 1, further comprising a communication port operably coupled to circuitry associated with the at least one optical sensor and configured for communication to a remote device selected from the group consisting of a remote processing system and a measurement-while-drilling communication system.

11. The drill bit of claim 1, wherein the electronics module comprises a sensor interface including a light source configured to transmit a light signal to the at least one optical sensor, to receive a light signal from the at least one optical sensor, or both.

12. The drill bit of claim 11, wherein the light source comprises a laser.

13. An apparatus for drilling a subterranean formation, comprising:

a bit bearing at least one cutting element and adapted for coupling to a drill string;

a chamber formed within the bit and configured for maintaining a pressure substantially near a surface atmospheric pressure while drilling the subterranean formation;

at least one optical sensor disposed in the drill bit and configured for sensing at least one physical parameter exhibited by the bit while drilling the subterranean formation; and an electronics module disposed in the drill bit and comprising:

a sensor interface comprising a light source and operably associated with the at least one optical sensor;

a memory; and a processor operably coupled to the memory and the sensor interface, the processor configured for executing computer instructions, wherein the computer instructions are configured for:

controlling delivery of a light signal from the light source to the at least one optical sensor; and analyzing a reflected light signal from the at least one optical sensor.

14. The apparatus of claim 13, wherein the at least one optical sensor is disposed in one of a channel foiined within the drill bit, the chamber, and a location proximate the at least one cutting element.

15. The apparatus of claim 13, wherein the computer instructions are further configured for generating a map illustrating at least one location and a degree of a physical parameter sensed by the at least one optical sensor at the at least one location.

16. The apparatus of claim 13, wherein the at least one optical sensor comprises at least one network of optical fibers configured for sensing an indication of the at least one physical parameter exhibited by the drill bit while drilling the subterranean formation.

17. A method, comprising:

providing at least one optical sensor within a drill bit;

measuring at least one physical parameter exhibited by the drill bit during a subterranean drilling operation with the at least one optical sensor; and generating a map correlated with the results of the measuring at least one physical parameter and illustrating one of temperature, pressure, and strain at one or more locations on the drill bit.

18. The method of claim 17, wherein providing at least one optical sensor within a drill bit comprises providing at least one network of optical fibers within the drill bit.

19. The method of claim 17, wherein providing at least one optical sensor within a drill bit comprises providing an optical fiber including at least one fiber Bragg grating formed therein.

20. The method of claim 17, wherein measuring at least one physical parameter comprises measuring at least one of a strain at one or more locations on or in the drill bit, a temperature at one or more locations on or in the drill bit, and a pressure at one or more locations on or in the drill bit.

21. The method of claim 20, further comprising determining at least one of an applied load at one or more locations on the drill bit, a torque at one or more locations on the drill bit, and an applied load on at least one cutting element on the drill bit from a strain measurement at one or more locations on or in the drill bit.

22. The method of claim 17, wherein measuring at least one physical parameter comprises delivering a light signal to the at least one optical sensor, and analyzing a reflected light signal from the at least one optical sensor.

23. The method of claim 17, further comprising comparing the generated strain map to a finite element analysis model of the drill bit.

* * * * *

UNITED STATES PATENT AND TRADEMARK OFFICE

CERTIFICATE OF CORRECTION

PATENT NO. : 8,087,477 B2
APPLICATION NO. : 12/435729
DATED : January 3, 2012
INVENTOR(S) : Eric C. Sullivan et al.

It is certified that error appears in the above-identified patent and that said Letters Patent is hereby corrected as shown below:

On the title page:

In ITEM (56) References Cited

OTHER PUBLICATIONS

Page 1, 2nd column, 2nd line of the 6th entry (line 23), after --1442-1462.-- insert a line break to create a new entry starting at --Wikipedia,--

In the claims:

| | | | |
|---|---|---|---|
| CLAIM 8, | COLUMN 10, | LINE 10, | change "the bit" to --the drill bit-- |
| CLAIM 14, | COLUMN 10, | LINE 55, | change "foiined" to --formed-- |
| CLAIM 17, | COLUMN 11, | LINE 6, | change "the results" to --results-- |

Signed and Sealed this
Sixth Day of May, 2014

Michelle K. Lee

Michelle K. Lee
*Deputy Director of the United States Patent and Trademark Office*